US009657554B2

(12) United States Patent
Morton, Jr. et al.

(10) Patent No.: US 9,657,554 B2
(45) Date of Patent: May 23, 2017

(54) DOWNHOLE FILTRATION TOOL

(71) Applicant: Stanley Filter Co., LLC, Tulsa, OK (US)

(72) Inventors: John L. Morton, Jr., Okmulgee, OK (US); John L. Morton, III, Pryor, OK (US)

(73) Assignee: Stanley Filter Co., LLC, Tulsa, OK (US)

( * ) Notice: Subject to any disclaimer, the term of this patent is extended or adjusted under 35 U.S.C. 154(b) by 714 days.

(21) Appl. No.: 13/965,998

(22) Filed: Aug. 13, 2013

(65) Prior Publication Data

US 2015/0047830 A1 Feb. 19, 2015

(51) Int. Cl.
*E21B 43/08* (2006.01)

(52) U.S. Cl.
CPC ..... *E21B 43/084* (2013.01)

(58) Field of Classification Search
CPC ..... E21B 43/086; E21B 43/08; E21B 17/042
See application file for complete search history.

(56) References Cited

U.S. PATENT DOCUMENTS 1,229,437 A * 6/1917 Foster ..... B01D 27/02 166/230
2,939,761 A * 6/1960 Stein ..... B29C 53/58 156/167
3,213,950 A * 10/1965 Ghelfi ..... E21B 7/18 166/205
3,547,272 A * 12/1970 Kalish ..... B01D 63/06 210/321.87
3,888,306 A * 6/1975 Wetzel ..... E21B 23/04 166/113
4,977,958 A 12/1990 Miller
5,490,680 A * 2/1996 Patel ..... F16J 15/062 277/608
6,322,616 B1 11/2001 Kennedy et al.
6,352,111 B1 3/2002 Bode et al.
7,695,549 B2 4/2010 Grubb et al.
7,789,137 B2 9/2010 Turley et al.
2006/0272824 A1* 12/2006 Adams ..... E21B 21/103 166/373

* cited by examiner

*Primary Examiner* — Jennifer H Gay
*Assistant Examiner* — Steven MacDonald
(74) *Attorney, Agent, or Firm* — Crowe & Dunlevy, P.C.

(57) ABSTRACT

A downhole filtration tool to remove sand and other solid particles from production fluid in a subterranean well. The downhole filtration tool includes a perforated mandrel surrounded by at least one filter element made of an open weave polymeric fiberglass material. In addition, the downhole filtration tool may include an additional screen or mesh installed in a separating annulus intermediate of the mandrel and the filter element to provide a filter having improved permeability and resistance to chemical and physical forces.

20 Claims, 8 Drawing Sheets

DOWNHOLE FILTRATION TOOL

BACKGROUND OF THE INVENTION

1. Field of the Invention

This invention relates generally to a downhole filtration tool for use in oil, gas, and water wells, and more particularly to a downhole filtration tool having a carbon steel mandrel surrounded by a non-metallic element giving the filter improved permeability, resistance to chemical breakdown, and physical strength.

2. Description of the Related Art

Oil and gas wells and water wells include a wellbore extending into a well to some depth below the surface. Typically, the wellbore is lined with casing to strengthen the walls of the borehole. To further strengthen the walls of the borehole, the annular area formed between the casing and the borehole is typically filled with cement to permanently set the casing in the wellbore. The casing is then perforated to allow production fluids to enter the wellbore and be retrieved at the surface of the well.

Various types of downhole equipment, such as pumps and similar devices, are used to move production fluids from within the wellbore to the surface. A typical downhole arrangement would include a string composed of a series of tubes or tubing suspended from the surface. One type of well-known pump is a downhole electrical submersible pump (ESP). The ESP either includes or is connected to a downhole motor which is sealed so that the whole assembly is submerged in the fluid to be pumped. The motor is connected to a power source at the surface and operates beneath the level of the fluid downhole in order to pump the fluid to the surface. A component is connected to the motor which prevents well fluid from entering the motor and equalizes internal motor pressure with the well annulus pressure.

A number of factors may be detrimental to the production of the ESP, such as the presence of foreign solid particles, such as sand, sediment, and scale. The amount and size of sand and other solid particles in the fluid may vary widely depending on the well and the conditions encountered. In enhanced recovery operations, for example, fluids may be pumped down the well to stimulate production causing additional movement of sands and solids. The sand and other solid particles act as abrasives and, over time, are damaging to the operation of the pump.

Yet another problem typically encountered in wells is an excess amount of gas or gas bubbles entering the intake of the pump causing the pump to decrease in efficiency. ESPs have dramatically lower efficiencies with significant fractions of gas, and at some point, the pump may become "gas locked" and damage to the pump and/or motor may result.

Many types of filters have been designed for use with ESPs. Such filters typically include a filter element designed to screen solid particles from the pump intake; however, the filtered particulates often become entrapped in the filter element. The amount of particulate material collected on the filter element is directly proportional to the to the pressure drop that occurs across the filter element. Since an excessive pressure drop across the filter element can significantly reduce fluid flow, the filter element must be periodically changed or cleaned. Often, this is done by removing the ESP from the fluid and removing the filter element. This can be a timely and inconvenient process. Pumps with intricate backwashing systems have been designed, but these are often expensive and cannot be used to retrofit existing systems. As a result, many pumps are generally operated without any filter and therefore experience early pump failure and extensive and costly down time.

A problem associated with conventional downhole filtration tools arises in high temperature and/or high pressure applications. High downhole temperatures are generally above 200° F. and up to 450° F., while high downhole pressures are generally above 7,500 psi and up to 15,000 psi. Another problem with downhole filtration tools occurs in both high pH (e.g., more than 8.0) and low pH (e.g., less than 6.0) environments. In these extreme downhole conditions, conventional filters become ineffective and suffer from degradation.

It is therefore desirable to provide an improved downhole filtration tool for use in oil, gas, and water wells.

It is further desirable to provide a downhole filtration tool that is connected to and suspended from downhole equipment, such as but not limited to, an ESP and operates as an intake to the pump.

It is still further desirable to provide a downhole fluid filtration tool capable of separating sand and other solid particles from production fluid while also preventing an undue amount of gas from entering the pump.

It is yet further desirable to provide a downhole filtration tool having a carbon steel mandrel surrounded by a non-metallic filter element giving the downhole filtration tool improved permeability, resistance to chemical breakdown, and physical strength.

SUMMARY OF THE INVENTION

In general, the invention relates to a downhole filtration tool having a metallic mandrel juxtaposed between opposing end fittings. The mandrel has a plurality of diametrical perforations and an interior chamber aligned along an axial flow passage through the downhole filtration tool. The end fittings have opposing generally planar axial or open ends axially aligned and coaxially spaced along the flow passage. The downhole filtration tool also has at least one open weave fiberglass filter element circumferentially surrounding the mandrel. The filter element includes a plurality of angularly biased passages extending upwardly at an angle, such as about 10 degrees, and approximately tangentially in relation to the annulus. The filter element includes vortex flow disrupter sections on opposing terminating ends. Each of the flow disrupter sections may be constructed from a rigid resin forming an internal annular shoulder. In addition, the downhole filtration tool includes a separating annulus between the filter element and the mandrel, with the end fittings closing terminal ends of the annulus.

The mandrel can also include a first terminating end with external threads and a second terminating end with external threads. The first terminating end and/or the second terminating end of the mandrel can include a mandrel threadlock, with each of the mandrel threadlocks being respectively axially aligned with a threadlock channel in the end fitting. The mandrel may be fabricated from investment cast precipitation-hardening corrosion-resistant steel, such as carbon steel, with the end fittings also being fabricated from steel.

Each of the end fittings can also include a reduced diameter neck with internal threads connected to the external threads of the first terminating end and the second terminating end of the mandrel. Further, each of the end fittings can include a sealing element supported within a circular seal groove for establishing sealing engagement with an external cylindrical sealing surface of the end fitting and an internal cylindrical sealing surface on the vortex flow disrupter section. Additionally, each of the end fittings can include circular sealing elements or seal assemblies located intermediate of an external, circular stop shoulder of the end fitting and the flow disrupter section. The seal assemblies can be carried within a circular seal groove.

The filter element of the downhole filtration tool may be fabricated from polyurethane, a phenolic, an epoxy resin or a blended epoxy resin, such as a low viscosity, liquid epoxy resin manufactured from bisphenol A or F and epichlorohydrin. The filter element can also be fabricated from a polymeric composite reinforced by fibers, such as glass, carbon and/or aramid, stacked in layers angled at about 30 degrees to about 70 degrees relative to an axis of the filter element.

Moreover, the downhole filtration tool can have a tight meshed screen or other filter media positioned within the separating annulus. The screen may be fabricated from stainless steel, a meta-aramid fiber, or a meta-aramid fiber blended with a para-aramid, antistatic or other synthetic fibers. The screen is supported by a mesh standoff along the perforations of the mandrel, and the filter element, the screen and the mesh standoff concentrically surround the mandrel.

Figure 1:
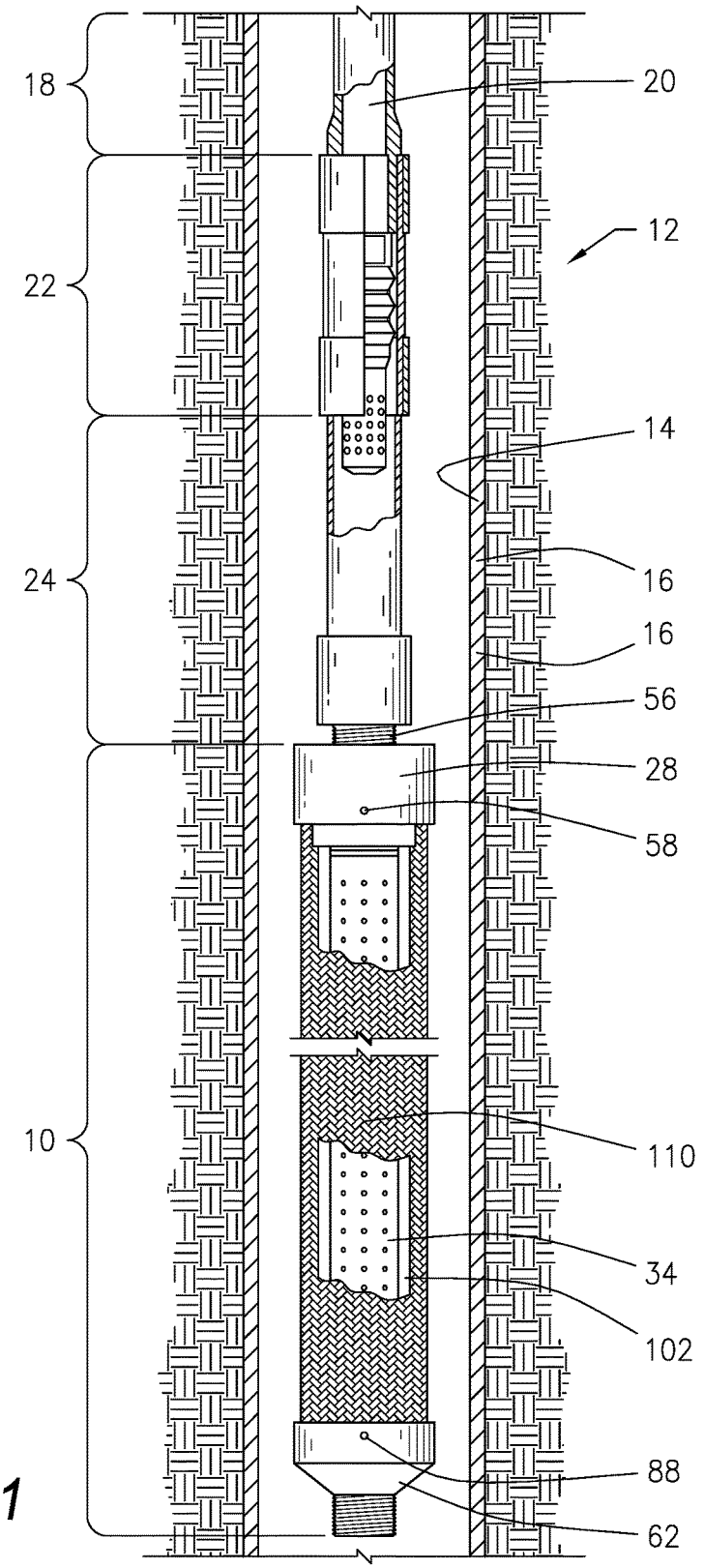
FIG. 1 is a sectional, partial cutaway view of downhole equipment incorporating the downhole filtration tool disclosed herein connected in a production string.
Figure 2:
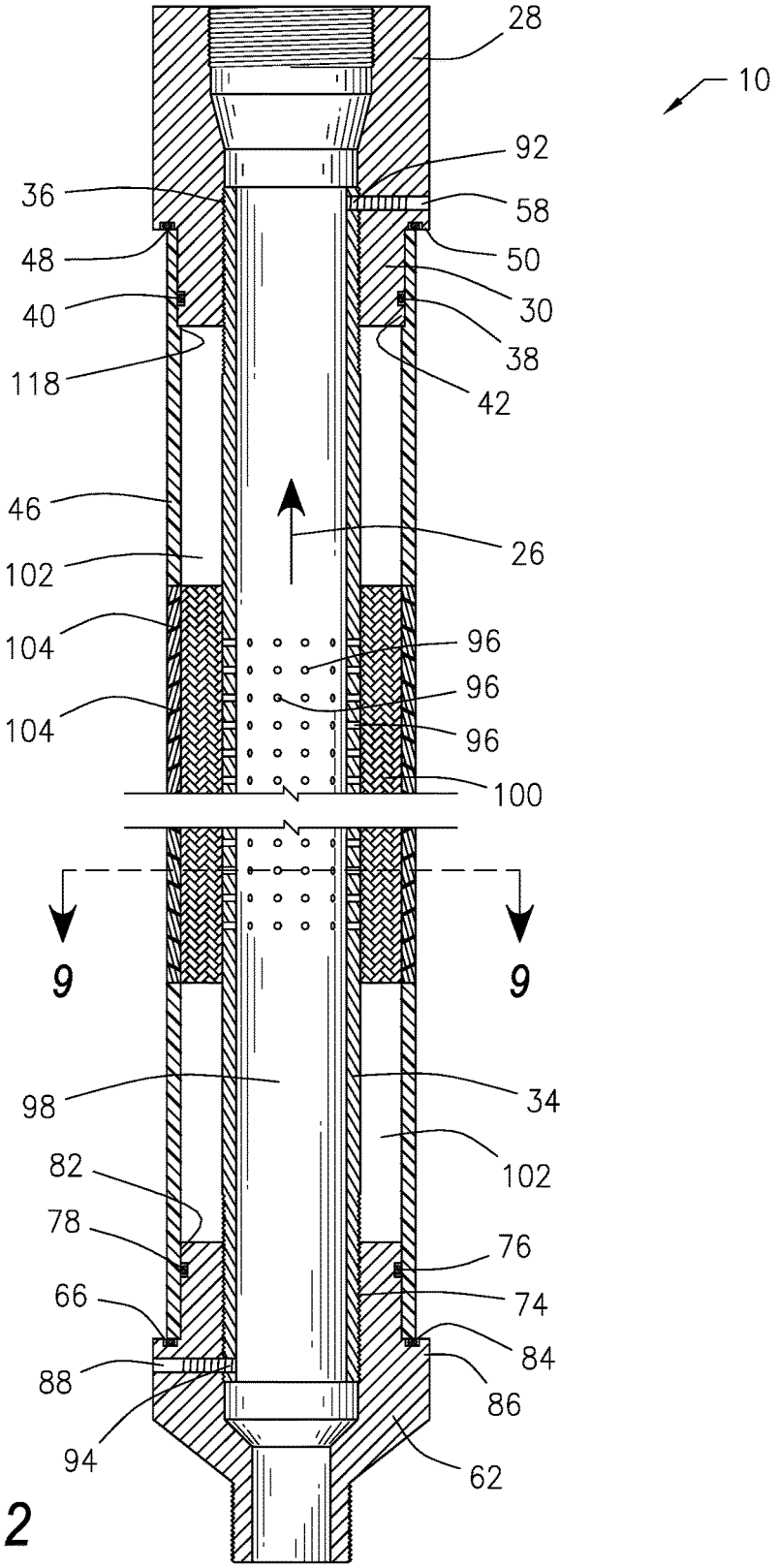
FIG. 2 is a diametric cross-sectional view of an example of a downhole filtration tool in accordance with an illustrative embodiment of the invention disclosed herein.
Figure 4:
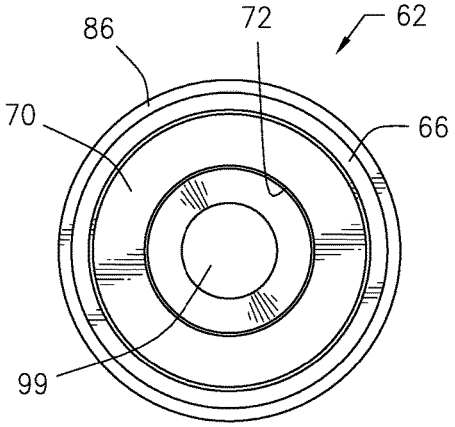
FIG. 4 is a top plan view of the mounting connector shown in FIG. 3.
Figure 5:
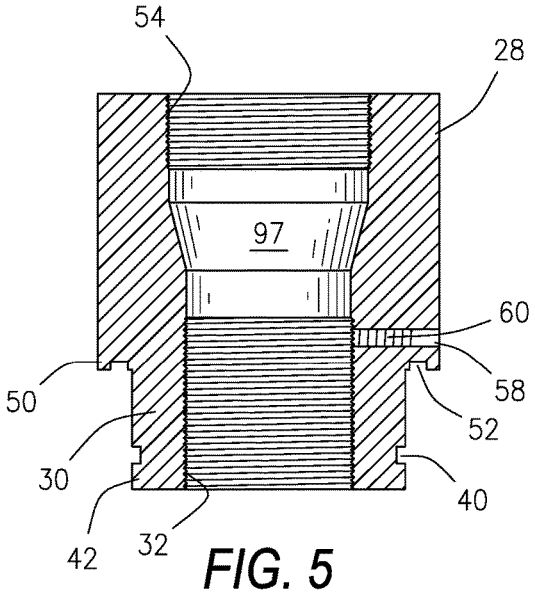
FIG. 5 is a cross-sectional view of an upper end fitting of the downhole filter tool shown in FIG. 2.
Figure 3:
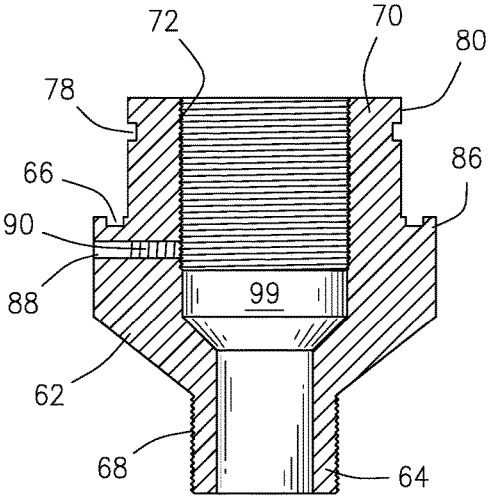
FIG. 3 is a cross-sectional view of a lower end fitting of the downhole filtration tool shown in FIG. 2.
Figure 6:
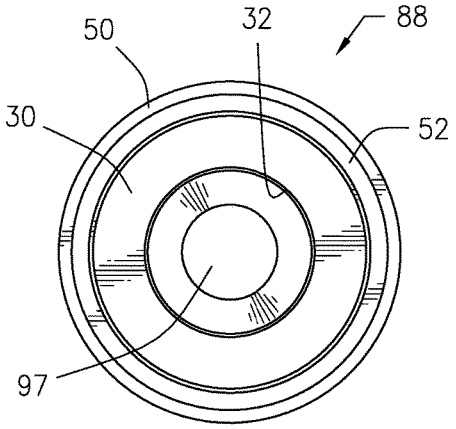
FIG. 6 is a bottom plan view of the coupler shown in FIG. 5.
Figure 7:
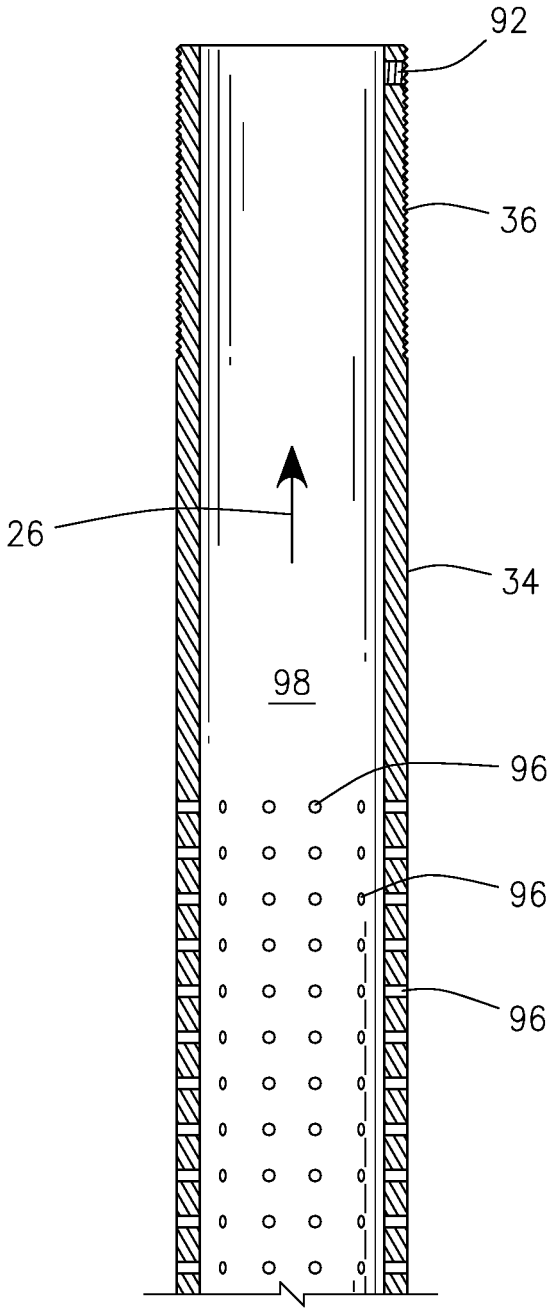
FIG. 7 is a cross-sectional view of the mandrel of the downhole filtration tool shown in FIG. 2.
Figure 8:
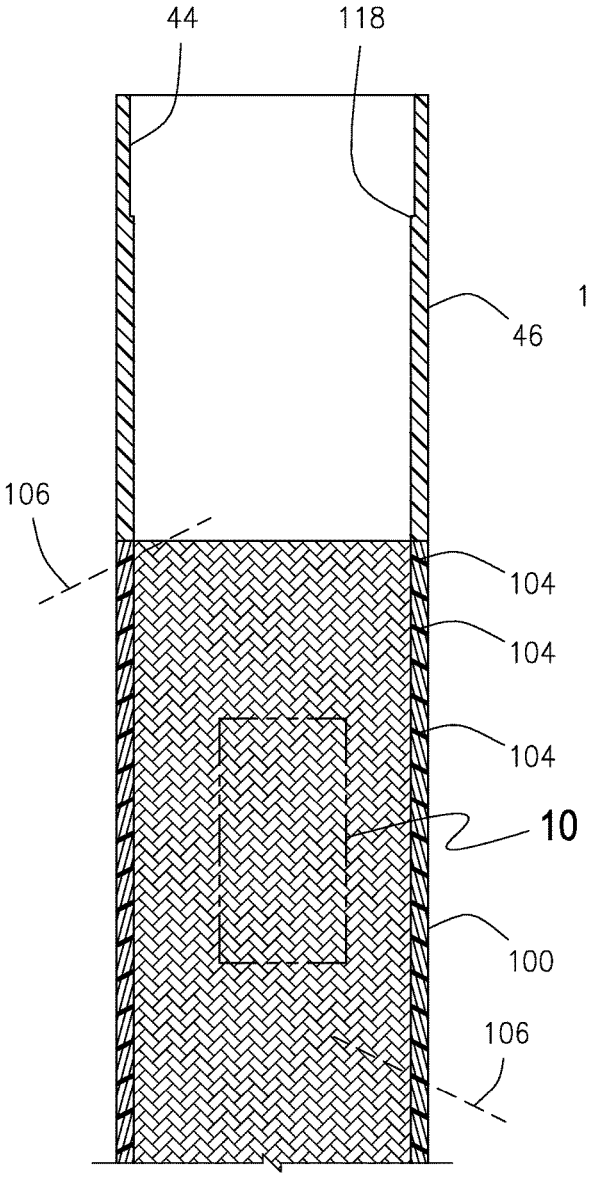
FIG. 8 is a cross-sectional view of the vortex flow disrupter section and the filter element of the downhole filtration tool shown in FIG. 2.
Figure 9:
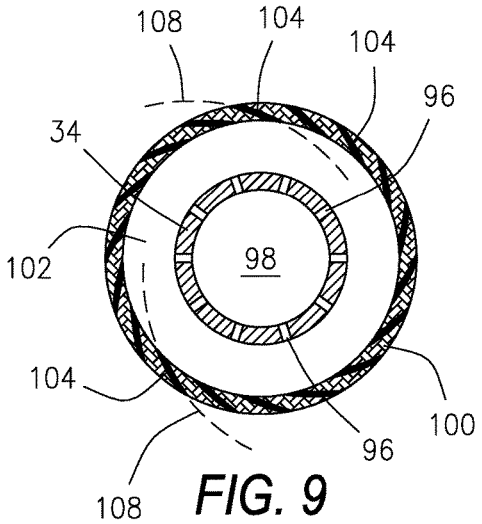
FIG. 9 is a cross-sectional view along line 9-9 of the downhole filtration tool shown in FIG. 2.
Figure 10:
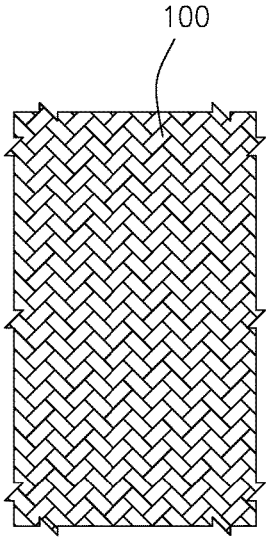
FIG. 10 is an exploded view of area 10 of the filter element as shown in FIG. 8.

Other advantages and features will be apparent from the following description and from the claims.

DETAILED DESCRIPTION OF THE INVENTION

The embodiments discussed herein are merely illustrative of specific manners in which to make and use this invention and are not to be interpreted as limiting in scope.

While the invention has been described with a certain degree of particularity, it is to be noted that many modifications may be made in the construction and the arrangement of its components without departing from the scope of the invention. It is understood that the invention is not limited to the embodiments set forth herein for purposes of exemplification.

The description of the invention is intended to be read in connection with the accompanying drawings, which are to be considered part of the entire written description of this invention. In the description, relative terms such as "front," "rear," "lower," "upper," "horizontal," "vertical," "above," "below," "up," "down," "top" and "bottom" as well as derivatives thereof (e.g., "horizontally," "downwardly," "upwardly" etc.) should be construed to refer to the orientation as then described or as shown in the drawings under discussion. These relative terms are for convenience of description and do not require that the machine be constructed or the method to be operated in a particular orientation. Terms, such as "connected," "connecting," "attached," "attaching," "join" and "joining" are used interchangeably and refer to one structure or surface being secured to another structure or surface or integrally fabricated in one piece.

Referring to the figures of the drawings, wherein like numerals of reference designate like elements throughout the several views, and initially to FIG. 1 depicting a sectional view of a downhole filtration tool 10 and downhole equipment used to raise production fluids to the surface. A subterranean well 12 includes a casing 14 which extends from the surface downhole. The casing 14 includes perforations 16 that allow production fluids to pass through the casing 14. An electrical submersible pump 18 is lowered into the well 12 beneath the level of fluid. The pump 18 is suspended from a string 20 which may be composed of a series of tubes or tubing suspended from the surface, such as from a rig or derrick (not shown). The pump 18 includes a motor (not shown) that is sealed from the fluids. The motor is powered by electrical energy supplied by an energy source at the surface, such as a generator (not shown). The pump 18 is connected to the downhole filtration tool 10 by way of a seating nipple 22 and/or a tubing sub 24. The pump 18, the motor, the seating nipple 22, the tubing sub 24 and other downhole equipment each has an external diameter less than an interior diameter of the casing 14. Downhole fluid enters the filtration tool 10 and is forced by the motor upward through an axial flow passage 26 of the downhole filtration tool 10 to the pump 18, which draws the fluid through the string 20 to the surface where it is collected in a tank (not shown) or otherwise delivered by a pipeline or other known means.

FIGS. 2 through 10 illustrate the downhole filtration tool 10 having a first end terminating in an upper end fitting 28, which connects with an intake end of the pump 18 or may be connected to other downhole equipment, such as the tubing sub 24. As illustrated, the end fitting 28 has a reduced diameter neck 30 with internal threads 32 that are connected to a first terminating end of a mandrel 34 with external threads 36. A sealing element 38 may be supported within a circular seal groove 40 of the neck 30, which establish sealing engagement with an external cylindrical sealing surface 42 of the end fitting 28 and an internal cylindrical sealing surface 44 on a first terminating end of a vortex flow disrupter section 46 of the downhole filtration tool 10. The end fitting 28 is also provided with circular sealing elements or seal assemblies 48 located intermediate of an external, circular stop shoulder 50 of the end fitting 28 and the flow disrupter section 46. The seal assemblies 48 may be carried within a circular seal groove 52. The sealing element 38 and/or the sealing assemblies 48 can be constructed from elastomer and polymer materials capable of accomplishing effective sealing at normal to high operating temperatures and at all pressure ranges. The end fitting 28 also includes an internally threaded section 54 that receives an externally threaded section 56 of the tubing sub 24 and other downhole equipment. Additionally, the end fitting 28 may include a threadlock channel 58 having internal threads 60.

The downhole filtration tool 10 has a second end terminating in a lower end fitting 62, which connects with the motor or other downhole equipment. The lower end fitting 62 has a first terminating end with a reduced diameter neck 64 having external threads 68 that are connected to the motor or other downhole equipment. The lower end fitting 62 also includes a second terminating end with a reduced diameter neck 70 having internal threads 72 that are connected to a second terminating end of the mandrel 34 with external threads 74. Similarly to the upper end fitting 28, the lower end fitting 62 may include a sealing element 76 supported within a circular seal groove 78 of the neck 70, which establish sealing engagement with an external cylindrical sealing surface 80 of the end fitting 62 and an internal cylindrical sealing surface 82 on a second terminating end of the vortex flow disrupter section 46 of the downhole filtration tool 10. The end fitting 62 is also provided with circular sealing elements or seal assemblies 84 located intermediate of an external, circular stop shoulder 86 of the end fitting 62 and the flow disrupter section 46. The seal assemblies 84 may be carried within a circular seal groove 66. The sealing element 76 and/or the sealing assemblies 84 can be constructed from elastomer and polymer materials capable of accomplishing effective sealing at normal to high operating temperatures and at all pressure ranges. Additionally, the end fitting 62 may include a threadlock channel 88 having internal threads 90.

The mandrel 34 is connected intermediate of and juxtaposed between the upper end fitting 28 and the lower end fitting 62. An interior chamber 98 within the mandrel 34 is axially aligned along the flow passage 26 through the downhole filtration tool 10. In addition, a central bore 97 in the upper end fitting 28 and a central bore 99 in the lower end fitting 62 have opposing generally planar axial or open ends that are axially aligned and coaxially spaced along the flow passage 26. The mandrel 34 includes the first terminating end with external threads 36 and the second terminating end with external threads 74. In addition, the first terminating end and/or the second terminating end of the mandrel 34 include a mandrel threadlock 92 and 94, which is axially aligned with the threadlock channel 58 in the upper end fitting 28 and the threadlock channel 88 in the lower end fitting 62, respectively. The mandrel 34 includes a plurality of diametrical perforations 96 along its length to permit fluids to pass from the well 12 into the interior chamber 98 within the mandrel 34. The perforations 96 may be round as illustrated or may be slotted or a combination of holes and slots that are punched or drilled through the mandrel 34. The mandrel 34 may be fabricated from investment cast precipitation-hardening corrosion-resistant steel, such carbon steel accompanied with steel upper and lower end fittings 28 and 62.

A removable filter element 100 concentrically surrounds the mandrel 34. A separating annulus 102 is formed between the filter element 100 and the mandrel 34, and the upper end fitting 28 and the lower end fitting 62 close a first terminating end and a second terminating end of the annulus 102. The filter element 100 includes a plurality of angularly biased passages 104 extending upwardly at an angle 106 of approximately 10 degrees and approximately tangentially 108 in relation to the annulus 102. If the filter element 100 becomes clogged or damaged, the filter element 100 may be removed and replaced as necessary. In addition, the filter element 100 may be constructed as single standalone elements or as stackable elements. A first end and a second end of the filter element 100 each respectively terminate with the vortex flow disrupter section 46. The flow disrupter section 46 is constructed of a rigid resin that forms a terminal end collar. The inner periphery of the disrupter section 46 may include an annular shoulder 118 that contacts the neck 30 of the end fitting 28.

The filter element 100 is an open weave fiberglass filter constructed to withstand very high or low pH environments as well as elevated temperatures and high pressure differentials. The filter element is constructed of a polymeric composite that is reinforced by a continuous fiber such as glass, carbon, or aramid, for example, having a porosity of between about 33% to about 43% per linear foot. The individual fibers are typically layered parallel to each other, and wound layer upon layer. However, each individual layer is wound at an angle of about 45 degrees to provide additional strength and stiffness to the composite material in high temperature and pressure downhole conditions. The polymeric composite may be polyurethane, a phenolic, an epoxy resin, such as a low viscosity, liquid epoxy resin manufactured from bisphenol A or F and epichlorohydrin (e.g., EPON™ Resin 862, Momentive Specialty Chemicals, Inc.) or a blended epoxy resin. Prepreg strands and rovings (e.g., Advantax®, Owens Corning Composite Materials, LLC; 346 Type 30® Roving, Owens Corning Composite Materials, LLC) can also be used to form a matrix or the fibers can be wet wound. A post cure process may be performed to achieve greater strength of the material, and heat can be added during the curing process to provide the appropriate reaction energy to drive the cross-linking of the matrix to completion. The composite may also be exposed to ultraviolet light or a high-intensity electron beam to provide the reaction energy to cure the polymeric composite. The foregoing materials are merely examples that may be utilized in constructing the downhole filtration tool 10 and other materials may be employed to suit the particular usage of the downhole filtration tool 10.

Figure 11:
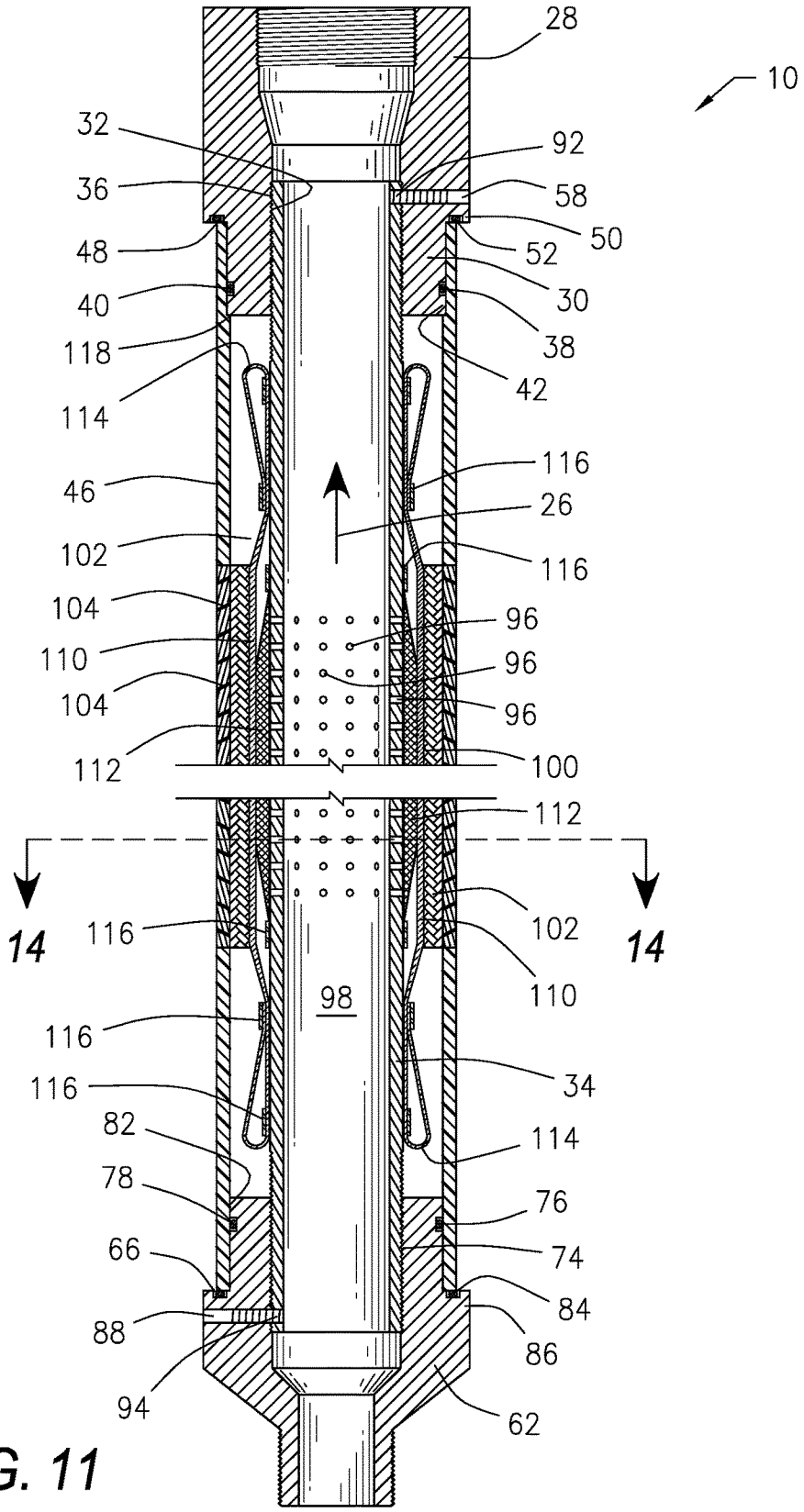
FIG. 11 is a diametric cross-sectional view of another example of a downhole filtration tool in accordance with an illustrative embodiment of the invention disclosed herein.
Figure 12:
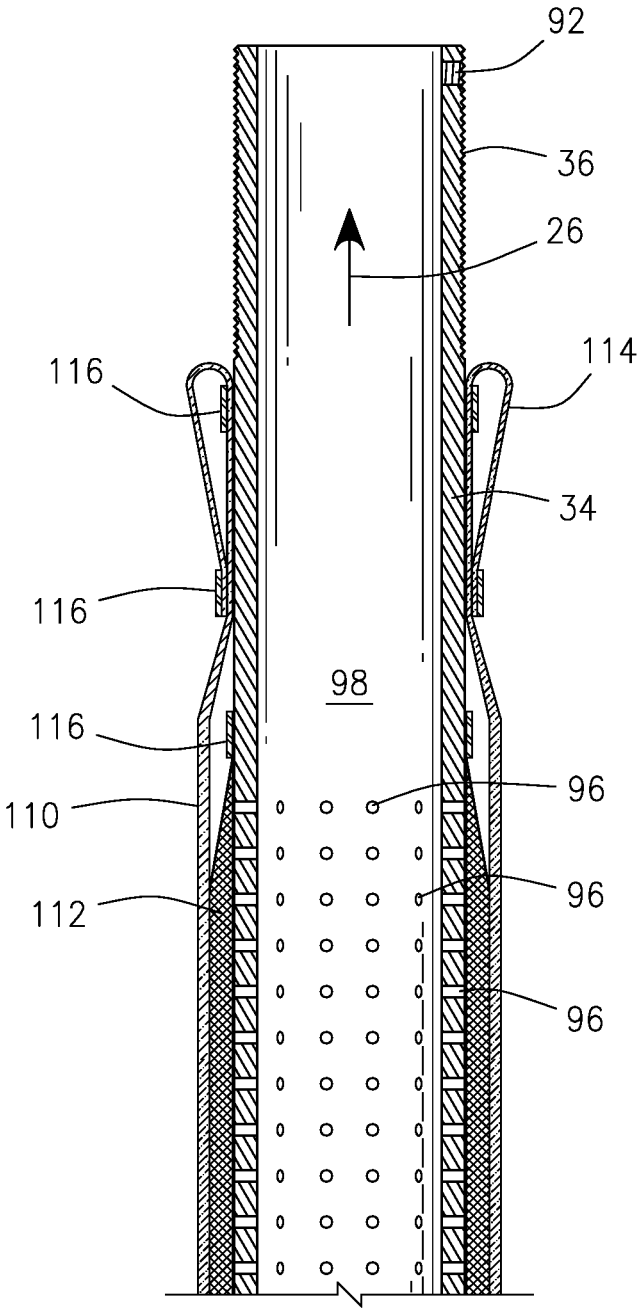
FIG. 12 is a cross-sectional view of the mandrel and the filter screen element of the downhole filtration tool shown in FIG. 11.
Figure 13:
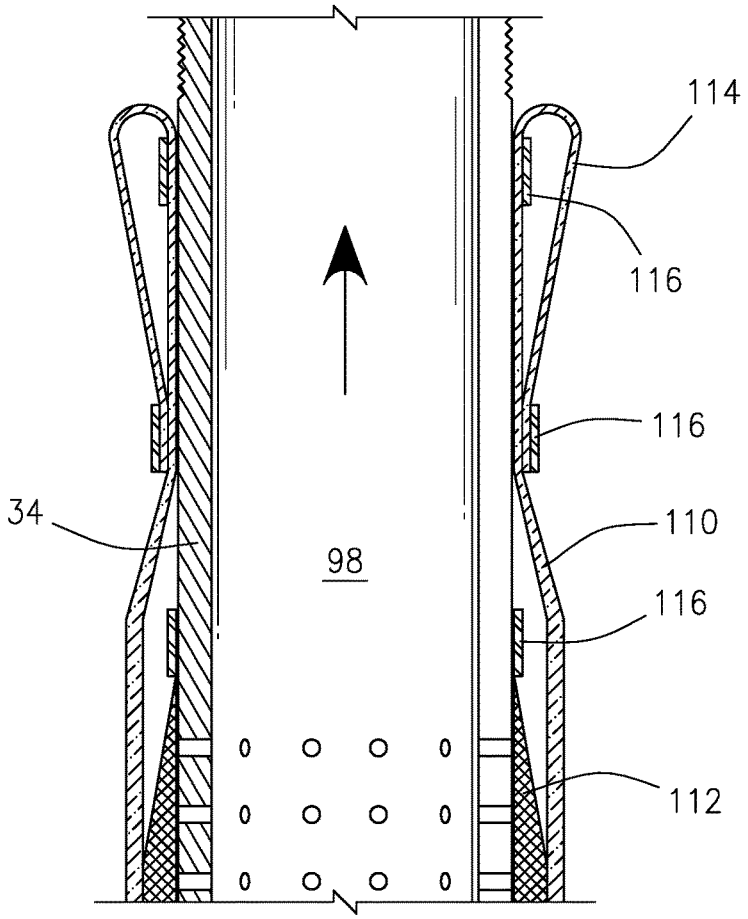
FIG. 13 is an exploded view of area 13 of the mandrel and the filter screen element as shown in FIG. 12.
Figure 14:
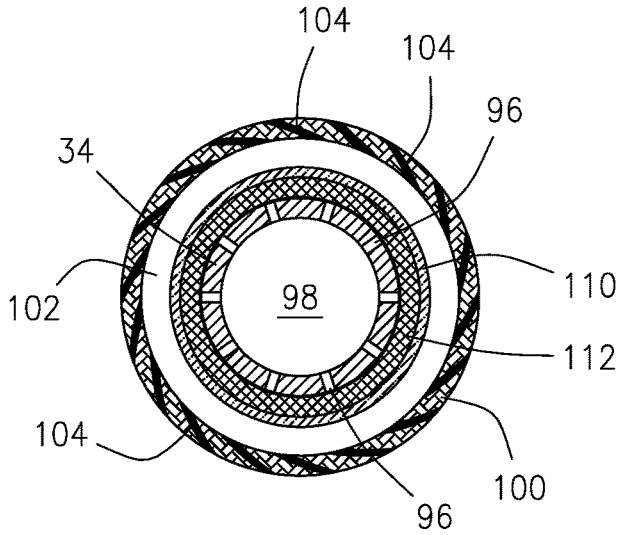
FIG. 14 is a cross-sectional view along line 14-14 of the downhole filtration tool shown in FIG. 11.

Referring now to FIGS. 11 through 13 illustrating an embodiment of the downhole filtration tool 10 having an additional tight meshed screen or other filter media 110 positioned within the separating annulus 102. The screen 110 may be constructed from stainless steel, a meta-aramid fiber (e.g., NOMEX®, Du Pont) or a meta-aramid fiber blended with a para-aramid, antistatic or other synthetic fibers. The screen 110 may be supported by a mesh standoff 112 along the perforations 96 of the mandrel 34. In addition, the terminating ends of the screen 110 may include a double fold 114. Terminating ends of the screen 110 and the mesh standoff 112 may be respectively secured to the mandrel 34 above the uppermost and below the lowermost perforations 96 by a suitable easily removable tape, band, strap or the like 116. As illustrated, the filter element 100, the screen 110 and the mesh standoff 112 concentrically surround the mandrel 34.

During operation, fluid from the well 12 will sequentially flow through the perforations 16 in the casing 14, through the filter element 100, through the screen 110, if present, and/or the mesh standoff 112, through the perforations 96 in the mandrel 36, through the interior chamber 98 of the mandrel 36 and through the upper end fitting 28 to an intake nut (not shown) and the pump 18. The casing perforations 16 will filter out larger solids and the filter element 100 will filter out smaller sand and other solid particles. The screen 110 and the standoff 112, if present, prevent loss of filter media through the perforations (16).

Whereas, the embodiments have been described in relation to the drawings, it should be understood that other and further modifications, apart from those shown or suggested herein, may be made within the scope of this invention.

What is claimed is:

1. A downhole filtration tool, comprising:

a metallic mandrel juxtaposed between opposing end fittings, said mandrel having a plurality of diametrical perforations and an interior chamber aligned along an axial flow passage through said downhole filtration tool, said end fittings having opposing generally planar axial or open ends axially aligned and coaxially spaced along said flow passage, at least one open weave fiberglass filter element circumferentially surrounding said mandrel, said filter element comprising a plurality of angularly biased passages extending upwardly at an angle and approximately tangentially in relation to said annulus, vortex flow disrupter sections coupled to opposing terminating ends of said filter element, each of said vortex flow disrupter sections constructed of a rigid resin, each of said vortex flow disruptor sections respectively in sealing engagement with a sealing element of said opposing end fittings; and a separating annulus between said filter element and said mandrel, said end fittings closing terminal ends of said annulus.

2. The downhole filtration tool of claim 1 wherein said mandrel further comprises a first terminating end with external threads and a second terminating end with external threads.

3. The downhole filtration tool of claim 2 wherein said first terminating end and/or said second terminating end of said mandrel include a mandrel threadlock.

4. The downhole filtration tool of claim 3 wherein each of said mandrel threadlocks are respectively axially aligned with a threadlock channel in said end fitting.

5. The downhole filtration tool of claim 2 wherein each of said end fittings further comprises a reduced diameter neck with internal threads connected to said external threads of said first terminating end and said second terminating end of said mandrel.

6. The downhole filtration tool of claim 1 wherein said mandrel is fabricated from investment cast precipitation-hardening corrosion-resistant steel.

7. The downhole filtration tool of claim 6 wherein said mandrel is fabricated from carbon steel and said end fittings are fabricated from steel.

8. The downhole filtration tool of claim 1 wherein each of said end fittings further comprises said sealing element supported within a circular seal groove for establishing sealing engagement with an external cylindrical sealing surface of said end fitting and an internal cylindrical sealing surface on said vortex flow disrupter section.

9. The downhole filtration tool of claim 1 wherein each of said end fittings further comprises circular sealing elements or seal assemblies located intermediate of an external, circular stop shoulder of said end fitting and said flow disrupter section.

10. The downhole filtration tool of claim 9 wherein said seal assemblies are carried within a circular seal groove.

11. The downhole filtration tool of claim 1 wherein said angularly biased passages of said filter element extending upwardly at an angle of approximately 10 degrees and approximately tangentially in relation to said annulus.

12. The downhole filtration tool of claim 1 wherein each of said flow disrupter sections further comprises an internal annular shoulder.

13. The downhole filtration tool of claim 1 wherein said filter element is fabricated from polyurethane, a phenolic, an epoxy resin or a blended epoxy resin.

14. The downhole filtration tool of claim 13 wherein said filter element is fabricated from a low viscosity, liquid epoxy resin manufactured from bisphenol A or F and epichlorohydrin.

15. The downhole filtration tool of claim 1 wherein said filter element is fabricated from a polymeric composite reinforced by fibers stacked in layers angled at about 30 degrees to about 70 degrees relative to an axis of said filter element.

16. The downhole filtration tool of claim 15 wherein said fibers further comprise glass, carbon and/or aramid.

17. The downhole filtration tool of claim 1 further comprising a tight meshed screen or other filter media positioned within the separating annulus.

18. The downhole filtration tool of claim 17 wherein said screen is fabricated from stainless steel, a meta-aramid fiber, or a meta-aramid fiber blended with a para-aramid, antistatic or other synthetic fibers.

19. The downhole filtration tool of claim 17 wherein said screen is supported by a mesh standoff along said perforations of said mandrel.

20. The downhole filtration tool of claim 17 wherein said filter element, said screen and said mesh standoff concentrically surround said mandrel.

* * * * *